United States Patent [19]

Bart

[11] 4,300,492

[45] Nov. 17, 1981

[54] THERMAL BARRIER VALVE

[75] Inventor: Hansueli Bart, Whitehall, Mich.

[73] Assignee: Eaton Corporation, Cleveland, Ohio

[21] Appl. No.: 104,928

[22] Filed: Dec. 18, 1979

Related U.S. Application Data

[63] Continuation of Ser. No. 908,330, May 5, 1978, abandoned.

[51] Int. Cl.[3] ..... F01L 3/00

[52] U.S. Cl. ..... 123/188 AA; 123/188 A

[58] Field of Search ..... 123/188 AA, 188 A, 668, 123/669, 660, 193 P, 193 C, 193 CP; 92/176, 224

[56] References Cited

U.S. PATENT DOCUMENTS

| | | | |
|---|---|---|---|
| 1,449,876 | 3/1923 | Williams | 123/188 |
| 1,605,838 | 11/1926 | Hanley, Jr. | 92/176 |
| 1,719,215 | 7/1929 | Faroy et al. | 123/668 |
| 1,868,138 | 7/1932 | Fisk | 123/188 A |
| 2,058,741 | 10/1936 | Taylor | 92/176 |
| 2,407,561 | 9/1946 | Lincoln | 123/188 AA |
| 2,450,803 | 10/1948 | Johnson | 123/188 AA |
| 2,513,939 | 7/1950 | Hoern | 123/188 AA |
| 2,840,427 | 6/1958 | Dolza | 92/176 |
| 2,947,582 | 8/1960 | Laagewaard | 92/176 |
| 3,473,444 | 10/1969 | Leffers | 92/176 |

FOREIGN PATENT DOCUMENTS

| | | | |
|---|---|---|---|
| 2333890 | 2/1975 | Fed. Rep. of Germany | 123/188 AA |

*Primary Examiner*—Charles J. Myhre
*Assistant Examiner*—Magdalen Moy
*Attorney, Agent, or Firm*—R. J. McCloskey; P. Rulon

[57] ABSTRACT

A thermal barrier for a diesel engine poppet valve is disclosed. The barrier includes a cup-shaped member having a shield portion spaced from the valve face and a cylindrical skirt portion welded to the valve head. The shield, skirt, and valve face define a hermetically sealed chamber which, when evacuated of gases, provides a heat conduction barrier for insulating the valve face from combusting gases. The chamber is preferably filled with a reinforcing to structurally support the shield and further insulate the valve face. The structural support may be in the form of an insulating material and/or a fabricated material having a low contact area with the shield and valve face.

10 Claims, 2 Drawing Figures

THERMAL BARRIER VALVE

This is a continuation of application Ser. No. 908,330, filed May 5, 1978, now abandoned.

BACKGROUND OF THE INVENTION

1. Field of the Invention

This invention relates to a thermal barrier for a combustion chamber and more specifically to a thermal barrier for a poppet valve in a combustion chamber of a piston engine.

2. Description of the Prior Art

Thermal barriers for protecting metal surfaces in piston engine combustion chambers from the deteriorating effects of heat and for reducing heat losses from the combustion chamber are well known. More specifically, heat barriers for internal combustion engine poppet valves have been proposed to reduce heat corrosion and weakening of the valve head, to improve or enhance combustion, to reduce heat conduction through the valve, etc. Prior art poppet valve thermal barriers have been bulky, heavy, expensive, poor insulators, and/or susceptible to failure and in some cases susceptible to catastrophic failure.

SUMMARY OF THE INVENTION

An object of this invention is to provide a combustion chamber thermal barrier which is compact, light in weight, inexpensive, a superior insulator, durable, and not susceptible to catastrophic failure.

Another object of this invention is to provide such a thermal barrier which is readily fixed to a poppet valve of standard or relatively standard configuration.

Another object of this invention is to provide a poppet valve thermal barrier which is effective enough to allow the use of relatively low cost metal alloys in the valve body and/or use of an otherwise conventional valve in a so-called adiabatic engine.

According to a feature of the invention, the thermal barrier includes a sheet metal shield disposed to face combusting gases in a combustion chamber of an expansible chamber engine and support means welded to the shield and defining in combination with the shield an evacuated, hermetically sealed chamber.

According to another feature of the invention, the shield and support means are connected together by a skirt which expands different amounts over its length between the shield and support means to minimize stresses due to differences in amount of thermal expansion between the shield and the support means.

According to another feature of the invention, the thermal barrier includes an evacuated, hermetically sealed chamber carried by a poppet valve; the valve includes a stem and a mushroom head having a face which is normally exposed to combusting gases; and the evacuated chamber is defined by the face and a cup-shaped metal member having a shield portion spaced from the face and a skirt portion which is welded to the head portion and which expands different amounts over its length between the shield and head portion to minimize stress due to difference in amount of thermal expansion between the shield and the head portion.

BRIEF DESCRIPTION OF THE DRAWING

The invention is shown in the accompanying drawing in which.

DETAILED DESCRIPTION OF THE DRAWING

Figure 1:
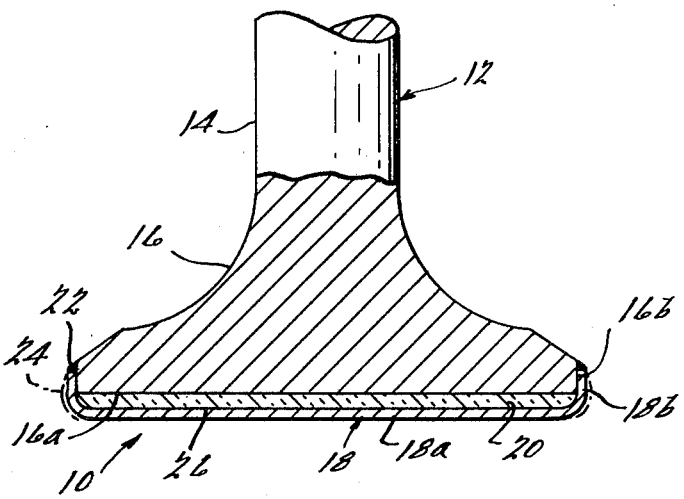
FIG. 1 shows one form of the invention heat barrier formed on the face of a partially shown poppet valve.

Referring now to FIG. 1, therein is shown a thermal barrier 10 supported by a poppet valve 12. Valve 12 is intended for use as an exhaust valve or intake valve in an expansible chamber engine of the internal combustion type which cyclically compresses and combusts gaseous mixtures, e.g., a piston engine. The invention thermal barrier is intended for use in a diesel engine; however, it is not so limited to such use. Further, the inventive features embodied in the construction of the barrier may be used to insulate a piston or a fire deck in an internal combustion engine.

Valve 12 includes a partially shown stem portion 14 and a mushroom head portion 16 shown in section. Head portion 16 includes a face **16*a* which is normally exposed to the combusting gases of a combustion chamber (not shown) and which is bounded by a cylindrical wall 16*b***.

Thermal barrier 10 includes a cup-shaped member 18 having a disk shaped shield portion **18*a* spaced from face 16*a*, and a cylindrical skirt portion 18*b* integrally formed with the shield and extending completely around the periphery of the shield. Skirt 18*b* embraces or circumscribes face 16*b*, telescopes over cylindrical wall 16*a*, and defines in combination with shield 18*a* and face 16*a* a chamber 20, which when evacuated and hermetically sealed provides a thermal barrier for conductively insulating the valve head from combusting gases. The end of skirt 18*b* distal from the shield is welded to wall 16*b* by a continuous weld 22 which hermetically seals chamber 20. The welding may be done in a vacuum by an electron beam welder, whereby chamber 20** is evacuated during the welding process.

An important purpose of skirt **18*b* is to minimize stresses caused by the difference in thermal expansion between shield 18*a* and head 16 of the valve. When valve 12 is installed in an engine, shield 18*a*, which is in direct contact with combusting gases, may reach temperatures ranging from 500 to 1,000 Fahrenheit degrees greater than head 16, whereby shield 18*a* will tend to thermally expand radially outward greater amounts than head 16. Restricting of the relative expansion between the shield and head causes stressing of the shield and the weld, which stresses can cause structural failure of the shield and/or weld. Skirt 18*b*, which is conductively connected to the shield and the head, therefore, has a temperature gradient over its length between the shield and the head. This gradient and radially outward forces from expansion of the shield causes skirt 18*b* to expand varying amounts over its length as shown by phantom line 24. The stresses due to the expansion are reduced by making the skirt length as long as practicable with respect to the diameter of the shield. Skirt lengths 1/10 to 1/12 of the shield diameter have been satisfactorily tested in a diesel engine without failure. The skirt readily allows the expansion, thereby preventing high stresses in the shield and in the weld. Phantom line 24** is shown greatly exaggerated for illustrative purposes.

The evacuated chamber 20 is preferably filled with an insulating material 26 to further improve radiation barrier insulating and to provide reinforcement of the shield 18*a*, which shield, due to its thinness, is subject to oil-canning from the cyclic pressures of the gaseous mixtures in the combustion chamber. The strength of the shield 18*a* may be further reinforced by forming the shield with curved or hemisperical shape. One insulating material, which has been tested and found to be a satisfactory insulator and an excellent reinforcement, is Zirconia. Another insulating material believed to be an excellent insulator and reinforcement is Min-K, manufactured by Johns-Manville Corporation.

Cup 18 is preferably fabricated from thin sheet metal alloy which is resistant to heat corrosion, such as Hastalloy-S. The thickness of the sheet metal is preferably as thin as possible, commensurate with structural integrity, to minimize added weight to the valve and heat transfer from the sheet metal to an incoming gaseous mixture prior to combustion. Skirt 18*b* of cup 18 may be formed by bending or drawing the outer periphery of a precut piece of sheet metal by well known manufacturing processes, e.g., by spinning or with draw dies. Cup 18 is preferably annealed after forming to relieve work hardening of the metal.

Thermal barrier valves with cup-shaped members 18 fabricated from Hastalloy-S in thicknesses of 0.010 in., 0.020 in., and 0.030 in. have been tested in a diesel engine for over 50 hours without failure of the cup, whereas thermal barrier valves with cups fabricated from Incolloy 617 in thicknesses of 0.010 in. failed after only a few hours of operation in the engine. Metallography inspection of the tested cups showed that the Hastalloy-S cups had grain sizes four to five times smaller than the grain sizes of the Incolloy 617 cups.

Figure 2:
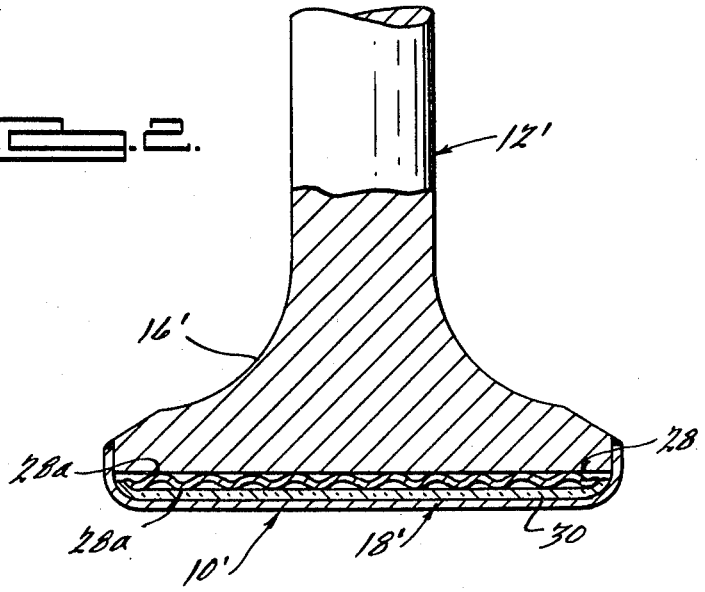
FIG. 2 shows another form of the invention heat barrier also formed on the face of a poppet valve.

Looking now at FIG. 2, this modified form of the thermal barrier differs mainly with respect to the manner of reinforcing shield 18*a*′, all other aspects being as described in FIG. 1. The reinforcement includes a lightweight skeletal structure or member 28 which may be formed of metal and should have a minimum weight and contact area with the valve face 16*a*′ and the shield 18*a*′ to minimize heat conduction from the shield to the valve face. A load distributing plate 30 may be inserted between shield 18*a*′ and member 28 to prevent pressure forming of the shield to the member at high temperatures. The surface of plate 30 in contact with shield 18*a*′ is preferably coated with a heat insulating material or roughened to minimize heat transfer from the shield to the plate.

Skeletal member 28 is preferably in the form of oppositely facing hemisperically shaped protrusions 28*a* or spikes which make point contact with the surface of plate 30 and valve face 16*a*′. Skeletal member 28 may also be in the form of a honeycombed or cellular structure. Further, the chamber spaces not occupied by member 28 may be filled with an insulating material such as Min-K.

Member 28 and plate 30 are preferably formed of metals having high strength properties at temperatures in the area of 2,000 degrees Fahrenheit. In addition, member 28 and/or plate 30 may be formed from metals which readily form oxides and nitrides once the valve is put into use in an engine. A few examples of such metals are chromium, titanium, tunsten, zirconium, and TCM. Such metals could be used to evacuate chamber 20′ of air, thereby negating the need to evacuate the chamber during the manufacturing process or to further evacuate the chamber, which as a practical matter could only be partially evacuated, during the manufacturing process.

Two embodiments of the invention have been disclosed for illustrative purposes. Many variations and modifications of the disclosed embodiments are believed to be within the spirit of the invention. The following claims are intended to cover the inventive portions of the disclosed embodiments and variations and modifications believed to be within the spirit of the invention.

What is claimed is:

1. In a poppet valve of the type including a mushroom head having a face portion which is normally exposed to cyclically combusting gases in a combustion chamber of an expansible chamber engine, a thermal barrier comprising:

a cup-shaped metal cap including a shield portion spaced from said face portion and a continuous skirt portion circumscribing said face portion and welded to said head, the surface of said face portion and the inner surfaces of said shield and skirt portions of said cap defining an evacuated chamber, said skirt portion operative to thermally expand radially by varying amounts over its length between said shield portion and said head in the presence of the heat of said combusting gases for minimizing stresses due to thermal expansion differences between said shield portion and said head, and said shield portion having an outer surface subjected to cyclical pressures of said cyclically combusting gases; and a heat insulating material disposed within said evacuated chamber for reducing radiation heat transfer through said evacuated chamber and for providing structural support over substantially the entire inner surface of said shield portion to prevent oil-canning of said shield portion due to said cyclical pressures.

2. In a device adapted for reciprocating movement in a combustion chamber of an engine, said device including a face portion normally exposed to combusting gases in said chamber, an improved thermal barrier comprising:

a cup-shaped metal cap including a shield portion spaced from said face portion and a skirt portion extending completely around said shield portion and circumscribing said face portion, said face portion and said skirt and shield portions of said cap defining a hermetically sealed and evacuated chamber for insulating said face portion from the heat of said combusting gases.

3. The thermal barrier of claim 2 wherein said device is a poppet valve.

4. The thermal barrier of claim 2 or 3, wherein said device includes sidewall means defining the outer periphery of said face portion and said skirt portion telescopes over said sidewall means.

5. In a poppet valve of the type including a mushroom head having a circular face portion normally exposed to combusting gases in a combustion chamber of an engine, an improved thermal barrier comprising:

a cup-shaped metal cap including a shield portion spaced from said face portion and a skirt portion integrally formed with and extending completely around said shield portion and circumscribing said face portion, said skirt portion welded to said head for forming a hermetically sealed and evacuated chamber defined by the surface of said face portion and the inner surfaces of said skirt and shield portions of said cap.

6. The thermal barrier of claim 5, wherein said mushroom head includes a cylindrical sidewall portion defining the outer periphery of said face portion and said skirt portion telescopes over said sidewall portion.

7. The thermal barrier of claim 2, 3, 5, or 6, further including:

a heat insulating material disposed within said evacuated chamber for reducing radiation heat transfer through said evacuated chamber and for providing structural support over substantially the entire inner surface of said shield portion.

8. In a poppet valve of the type including a mushroom head having a cylindrical wall portion defining the outer periphery of a face portion normally exposed to cyclically combusting gases in a combustion chamber of an expansible chamber engine, an improved thermal barrier comprising:

a cup-shaped metal cap including a shield portion spaced from said face portion and a continuous skirt portion telescoped over said cylindrical wall portion and welded to said head at the end of said skirt portion distal from said shield portion, the surface of said face portion and the inner surfaces of said shield and skirt portions of said cap defining an evacuated chamber, said skirt portion operative to thermally expand radially by varying amounts over its length between said shield portion and said head in the presence of the heat of said combusting gases for minimizing stresses due to thermal expansion differences between said shield portion and said head, and said shield portion having an outer surface subjected to cyclical pressures of said cyclically combusting gases; and a heat insulating material disposed within said evacuated chamber for reducing radiation heat transfer through said evacuated chamber and for providing structural support over substantially the entire inner surface of said shield portion to prevent oil-canning of said shield portion due to said cyclical pressures.

9. The valve of claim 1, 2, 5, or 8, wherein said cap is formed from a sheet metal alloy resistant to heat corrosion and having an average grain size diameter which is less than one-quarter the thickness of the sheet metal.

10. The thermal barrier of claim 1, 2, 3, 5, 6, or 8, wherein said shield portion is a substantially flat disk.

* * * * *